US008577271B2

(12) United States Patent
Barton et al.

(10) Patent No.: US 8,577,271 B2
(45) Date of Patent: Nov. 5, 2013

(54) APPARATUS AND SYSTEMS INCLUDING BELT-ROLL FUSER STRIPPING SHOE WITH ROBUST COMPLIANT TIP

(75) Inventors: Augusto E. Barton, Webster, NY (US); Paul M. Fromm, Rochester, NY (US); William A. Burton, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 301 days.

(21) Appl. No.: 13/076,934

(22) Filed: Mar. 31, 2011

(65) Prior Publication Data

US 2012/0251202 A1 Oct. 4, 2012

(51) Int. Cl.
*G03G 15/20* (2006.01)

(52) U.S. Cl.
USPC ..... 399/323; 399/329

(58) Field of Classification Search
USPC ..... 399/323, 329, 398
See application file for complete search history.

(56) References Cited

U.S. PATENT DOCUMENTS

| | | | | |
|---|---|---|---|---|
| 7,398,045 | B2 * | 7/2008 | Uehara et al. | 399/329 |
| 7,463,857 | B2 * | 12/2008 | Baba et al. | 399/323 |
| 7,567,766 | B2 * | 7/2009 | Miyata et al. | 399/329 X |
| 7,801,473 | B2 * | 9/2010 | Ando | 399/323 |
| 7,817,950 | B2 * | 10/2010 | Burton et al. | 399/323 |
| 8,073,372 | B2 * | 12/2011 | Mcnamee et al. | 399/323 |
| 2010/0111579 | A1 * | 5/2010 | Condello et al. | 399/329 |
| 2011/0064491 | A1 * | 3/2011 | Kono et al. | 399/329 |

* cited by examiner

*Primary Examiner* — Sandra Brase
(74) *Attorney, Agent, or Firm* — Ronald E. Prass, Jr.; Prass LLP

(57) ABSTRACT

A belt-roll fuser stripping system has a stripping shoe and a stripping shim. The shim is support by a support member. The support member supports the shim to maintain a desired nip pressure profile, and reduce deformation and wear of the shim and belt-roll fuser components.

18 Claims, 4 Drawing Sheets

APPARATUS AND SYSTEMS INCLUDING BELT-ROLL FUSER STRIPPING SHOE WITH ROBUST COMPLIANT TIP

FIELD OF DISCLOSURE

The disclosure relates to belt-roll fuser apparatus and systems including a stripping system having a stripping shoe. Specifically, the disclosure relates to a stripping system having a stripping shoe and a robust compliant tip that maintains an effective nip pressure profile at a fusing nip.

BACKGROUND

Related art belt-roll fuser stripping systems may include a stripping shoe that is used to load an inner side of a fusing belt to accommodate an effective fusing nip pressure. The nip pressure may be brought above water vapor and/or air bubble pressure limits, particularly during fusing. For example, a shim and shoe combination may be used to place a load on an inner side of a belt that passes through the nip. The combination is arranged at an exit of the fusing nip, the nip being defined by an external pressure roll, and an internal pressure roll, which entrains the fuser belt.

SUMMARY

Related art stripping systems in belt-roll fuser systems may require frequent maintenance. It has been found that a shim in a shim and shoe combination of related art stripping systems may require replacement every 100 kprints. The shim tends to catch at a point between the belt and the internal pressure roll of the belt-roll fuser. This may be a result of the shim deforming, and/or weakening over time. Other components of the belt-roll fuser, including the fuser belt, may be damaged by a portion of a deformed and/or weakened shim.

In apparatus and systems in accordance with embodiments, instances of fuser belt damage may be reduced, and the useful lives of stripping system and fusing system components may be extended. For example, a belt-roll fuser stripping apparatus may be configured to include a stripping shoe. A shim may be attached to the stripping shoe. For example, the shim may be attached to a support member, which may be attached to the shoe. In an embodiment, the shim may be attached to the shoe at a first end of the shim, and the shim may extend to a second end forming a stripping edge that interposes a fuser belt and a pressure roll at an exit of a fuser nip of the fusing system.

In an embodiment, the shim may be compliant, and may be supported by a support member. The support member may be formed of rubber, foam, or other material suitable for providing support. The support member may be formed during manufacture of the stripping system by injection into a space defined by the shim and the stripping shoe to which the shim is attached. Alternatively, the support member may be formed separately and later attached and positioned to provide support to the shim such that a suitable nip pressure profile accommodated by the shim may be maintained.

In another embodiment, the shim may be formed to surround a support member, so that the shim interposes the support member and a pressure member that defines the fusing nip. For example, the shim may be formed to include a first end and a second. The first end may be attached to the stripping shoe. In another embodiment, the shim may extend from the first end to surround the support member. The shim may be attached to the stripping shoe at a second end of the shim. A portion of the shim located between the first end and the second end may interpose a fusing belt and a nip-defining member of the belt-roll fuser, and may be configured to transfer a load to an inner side of the fuser belt by way of the stripping shoe to which the shim is attached by at least one of the first and second ends.

An embodiment of a belt-roll fuser system may include a stripping system. The stripping system may include a stripping shoe and a stripping shim. The stripping shim may be attached to the stripping shoe at a first end, and supported by a support member. A second end of the stripping shim may extend to interpose an inner side of a fuser belt and a fuser roll entraining the fuser belt, at an exit of a fusing nip that the fuser roll defines. Alternatively, the stripping shim may be attached to the stripping shoe at a first end of the shim. The stripping shim may extend from the first end to surround a support member, and may be attached to the stripping shoe at a second end of the stripping shim.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
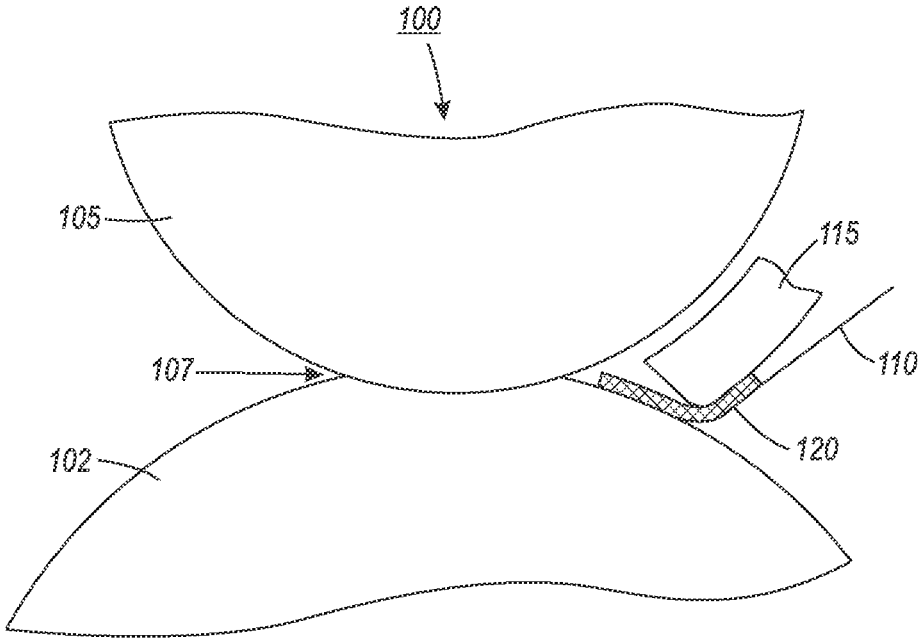
FIG. 1 (Prior Art)
FIG. 1 shows a diagrammatical side view of a belt-roll fuser having a related art stripping system.

Exemplary embodiments are intended to cover all alternatives, modifications, and equivalents as may be included within the spirit and scope of the apparatus and systems as described herein.

Reference is made to the drawings to accommodate understanding of belt-roll fuser apparatus and systems including a stripping system having a stripping shoe with a shim. In the drawings, like reference numerals are used throughout to designate similar or identical elements. The drawings depict various embodiments and data related to embodiments of illustrative apparatus and systems having a stripping system.

Apparatus and systems of embodiments may include systems for printing images on media by fusing marking material to a substrate using a belt-roll fuser. A belt-roll fuser may include two rotatable members that together define a fusing nip. For example, a belt-roll fuser may include a first member, e.g., an internal pressure member, and a second member, e.g., an external pressure member. The internal pressure member and the external pressure member may be configured to define the fusing nip. The internal pressure member may entrain a fusing belt that passes through the nip.

Media such as a substrate having marking material deposited thereon may be fed through the fusing nip. The fusing system may be configured to apply, e.g., pressure and heat at the nip to fuse the marking material to the substrate. The fuser belt that is entrained by one or more rotatable members of the belt-roll fuser, including the internal pressure member, may contact a substrate at the nip during fusing.

An embodiment of a stripping system, which may be included in belt-roll fuser systems, includes a support member configured to enhance performance of stripping system components, including, e.g., a shim associated with a stripping shoe. For example, a stripping system may include a stripping shoe and a shim, which are positioned near a fusing nip exit. The shim may be attached to the stripping shoes at one or more points.

The shim may have a first end and a second end. In an embodiment, a first end of the shim may be attached to the stripping shoe. The shim may extend from the first end, toward the fixing nip exit, to a second end of the shim. The stripping shoe and shim, which is supported by a support member, may be configured to apply a load to an inner side of the fuser belt, i.e., the side of the fuser belt that faces the internal pressure member. A stripping edge may be formed at a second end of the shim for contacting the inner side of the fuser belt.

The shim may be formed of any suitable material now known or later developed. For example, a shim may be formed of a material comprising stainless steel or spring steel. The shim may be deformable, such that a stripping edge located, e.g., at a second end of the shim may deform, or cause a portion of the shim to deform when applied to, e.g., an inner side of a media transport belt that passes through the fusing nip. Further, over time, the shim may become weakened and loose shape. Accordingly, in embodiments, the shim may be supported by a support member. The support member may be configured to interpose the shim and the stripping shoe.

The support member may be formed of any material suitable for providing support to the shim. For example, the support member may be formed of rubber, and/or foam. The support member may be formed by, e.g., injecting material into a space defined by the shim and the stripping shoe to which the shim is attached. Another method may include adhering the metal shim with an adhesive after the rubber has been formed on the shoe tip.

FIG. 1 shows a diagrammatical side view of a fusing nip of a belt-roll fuser system having a related art stripping system. Specifically, FIG. 1 shows a fusing system 100 having a first member and a second member that define a fusing nip. The first member, an external pressure member 102, may be a drum or a roll that is rotational about its longitudinal axis. The second member, internal pressure member 105, may be an internal pressure roll that is rotatable about a longitudinal axis. The internal pressure member 105 may be a roll or drum, or any other suitable structure. The internal pressure member 105 and the external pressure member 102 define a fusing nip 107.

Media carrying marking material images thereon for fusing may be fed through the fusing nip 107. The fusing nip 107 may have a nip entrance and nip exit, with respect to a process direction. A substrate having a marking material image deposited on its surface may be carried in a process direction to the fusing nip 107 for fusing the image to the substrate. Specifically, the image may be fixed by, e.g., applying heat and/or pressure to the marking material and substrate as the substrate passes through the nip 107.

A fuser belt 110 may be entrained by one or more members of the belt-roll fuser, including the internal pressure member 105. The fuser belt 110 may have a first side and a second side. The first side may contact a substrate that passes through the fusing nip 107. The second side may be an inner side that contacts the internal pressure member 105, and that may contact other members of the belt-roll fuser that entrain the fuser belt 110.

The fusing system 100 shown in FIG. 1 includes a stripping system. The stripping system includes a stripping shoe 115 and a stripping shim 120. The stripping shim 120 has a first end that is attached to the stripping shoe 115. The shim 120 may be elongate and angled as shown, and may extend to a second end positioned near nip 107. A stripping edge may be formed at the second end, and may be configured to load an inner side or second side of the fusing belt 110.

In particular, the stripping shoe 115 and the stripping edge that contacts the fuser belt are applied to an inner side of the belt (e.g., the side of the belt 110 that faces the internal pressure member 105) to maintain a pressure profile. A pressure profile at the nip should be maintained such that a nip pressure is above a water vapor pressure limit. Further, a pressure profile at the nip should be maintained such that the nip pressure is above an air bubble pressure limit. In related art systems, the shim 120 and the stripping shoe 115 may be arranged as shown in FIG. 1, wherein the shim 120 is elongate and angled, such that open space interposes a stripping edge of the shim 120 and the stripping shoe 115 to which the shim 120 is attached at the first end of the shim 120. The related art arrangement results in deformation, weakening, and/or wear of the shim 120. When the shim 120 is deformed or weakened, the shim 120 may become caught on components of the fusing system 100. For example, it has been found that a weakened or deformed shim 120 may damage the belt 110.

In addition to damage of fusing system 100 components, the pressure profile degrades as the shim 120 wears and/or deforms. As such, the shim 120 requires frequent replacement. For example, related are systems such as that shown in FIG. 1 may require replacement of the shim 120 after every 100 Kprints.

Figure 2:
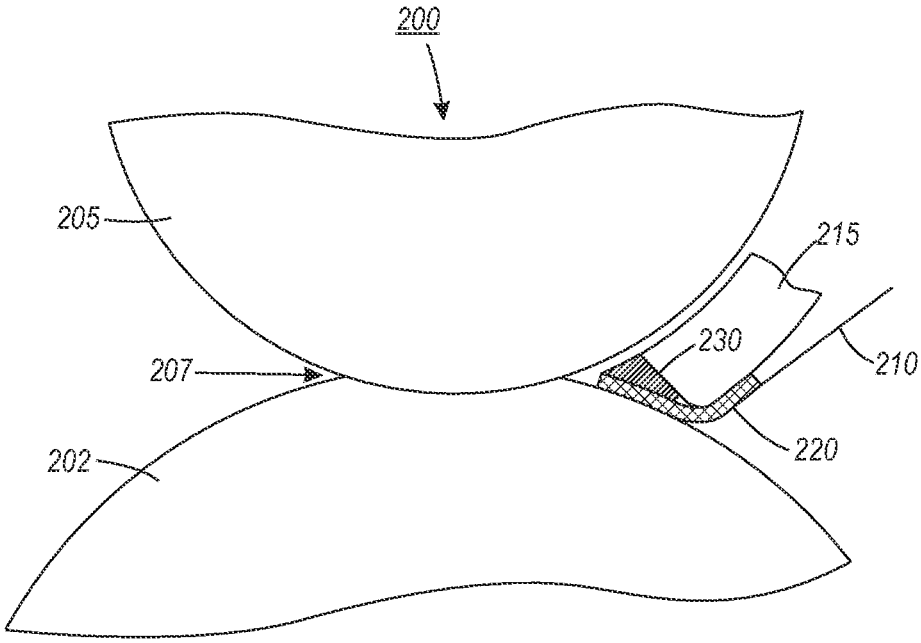
FIG. 2 shows a diagrammatical side view of a belt-roll fuser having a stripping system in accordance with an exemplary embodiment.

FIG. 2 shows a diagrammatical side view of a fusing system 200 having a stripping system. Specifically, FIG. 2 shows a fusing system 200 having a first member and a second member that define a fusing nip. The first member, an external pressure member 202, may be a drum or a roll that is rotational about its longitudinal axis. The second member, internal pressure member 205, is rotatable about a longitudinal axis. The internal pressure member 205 may be a roll or drum, or any other suitable structure. The internal pressure member 205 and the external pressure member 202 define a fusing nip 207.

Media carrying marking material thereon for fusing may be fed through the fusing nip 207. The fusing nip 207 may have a nip entrance and nip exit, with respect to a process direction. A substrate having a marking material image deposited on its surface may be carried in a process direction to the fusing nip 207 for fusing the image to the substrate. Specifically, the image may be fixed by, e.g., applying heat and/or pressure to the marking material and substrate as the substrate passes through the nip 207.

A fuser belt 210 may be entrained by one or more members of the belt-roll fuser, including the internal pressure member 205. The fuser belt 210 may have a first side and a second side. The first side may contact a substrate that passes through the fusing nip 207. The second side may be an inner side that contacts the internal pressure member 205, and that may contact other members of the belt-roll fuser that entrain the fusing belt 210.

The fusing system 200 shown in FIG. 2 includes a stripping system in accordance with apparatus and systems of embodiments. The stripping system includes a shoe 215 and a stripping shim 220. The stripping shim 215 has a first end that is attached to the stripping shoe 215. The shim 220 may be elongate and angled as shown, and may extend to a second end positioned near nip 207. A stripping edge may be formed at the second end, and may be positioned to load an inner side or second side of the fusing belt 210.

In particular, the stripping edge and the stripping shoe 215 are applied to an inner side of the belt (e.g., the side of the belt 210 that faces the internal pressure member 205) to maintain a pressure profile. Specifically, a pressure profile at the nip should be maintained such that a nip pressure is above a water vapor pressure limit. Further, a pressure profile at the nip should be maintained such that the nip pressure is above an air bubble pressure limit.

The stripping system of FIG. 2 includes a support member 230. The support member 230 is configured to provide support to the shim 220. For example, as shown in FIG. 2, the support member 230 may be positioned to interpose a stripping edge of the shim 220 and the shoe 215 to which the first end of the shim 220 is attached. The support member 230 may be positioned to contact the shim 220, and provide support thereto. The support member 230 may be composed of rubber and/or foam. Fusing systems and stripping systems having a supported shim in accordance with embodiments, such as stripping systems having a support member 220 as shown in FIG. 2, may be resistant to deformation, weakening, and/or wear.

Figure 3:
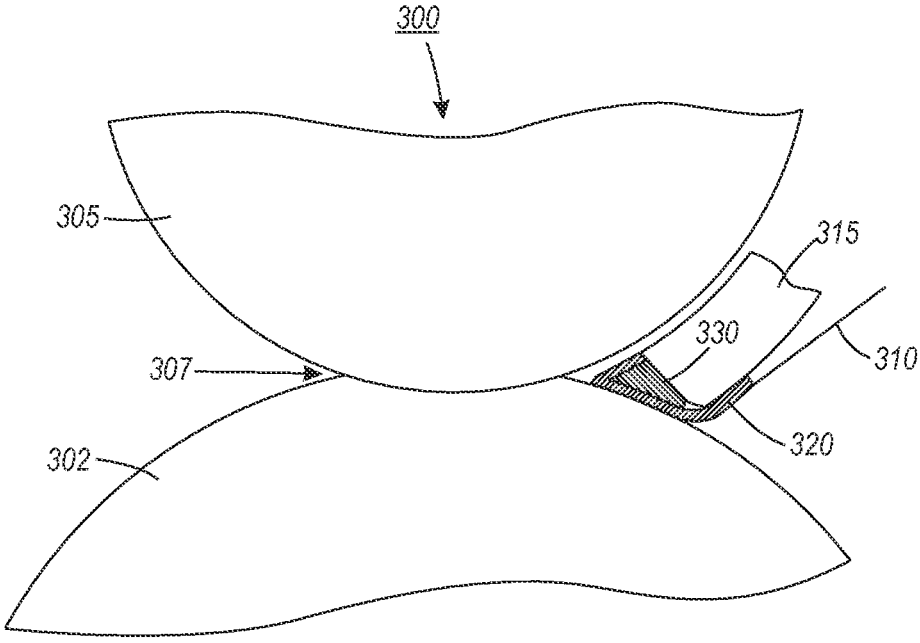
FIG. 3 shows a diagrammatical side view of a belt-roll fuser having a stripping system in accordance with another exemplary embodiment.

FIG. 3 shows a diagrammatical side view of a fusing system 300 having a stripping system in accordance with an exemplary embodiment. Specifically, FIG. 3 shows a fusing system 300 having a first member and a second member that define a fusing nip. The first member, an external pressure member 302, may be a drum or a roll that is rotational about its longitudinal axis. The second member, an internal pressure member 305, may be an internal pressure roll that is rotatable about a longitudinal axis. The internal pressure member 305 may be a roll or drum, or any other suitable structure. The internal pressure member 305 and the external pressure member 302 define a fusing nip 307.

Media carrying marking material images thereon for fusing may be fed through the fusing nip 307. The fusing nip 307 may have a nip entrance and nip exit, with respect to a process direction. A substrate having a marking material image deposited on its surface may be carried in a process direction to the fusing nip 307 for fusing the image to the substrate. Specifically, the image may be fixed by, e.g., applying heat and/or pressure to the marking material and substrate as the substrate passes through the nip 307.

A fuser belt 310 may be entrained by one or more members of the belt-roll fuser, including the internal pressure member 305. The fuser belt 310 may have a first side and a second side. The first side may contact a substrate that passes through the fusing nip 307. The second side may be an inner side that contacts the internal pressure member 305, and that may contact other members of the belt-roll fuser that entrain the fusing belt 310.

The fusing system 300 shown in FIG. 3 includes a stripping system. The stripping system includes a stripping shoe 315 and a stripping shim 320. The stripping shim 320 has a first end that is attached to the stripping shoe 315. The shim 320 may be elongate and angled as shown, and may extend to a second end that may be positioned toward and/or attached to the stripping shoe 315.

In particular, the stripping shim 320 may extend from the first end of the shim to surround and at least partially enclose a support member 330. The shim 320 shown in FIG. 3 is angled to define a stripping edge at a point between the first end and the second end of the shim. The stripping edge may be positioned near a nip exit. The stripping edge may be applied to an inner side of the belt (e.g., the side of the belt 310 that faces the internal pressure member 305) to maintain a pressure profile. A pressure profile at the nip should be maintained such that a nip pressure is above a water vapor pressure limit. Further, a pressure profile at the nip should be maintained such that the nip pressure is above an air bubble pressure limit.

The stripping system of FIG. 3 includes a support member 330. The support member 330 is configured to provide support to the shim 320, which substantially surrounds the support member 330. The support member 330 may be positioned to contact the shim 320, and provide support thereto. The support member 230 may be formed of rubber, and/or foam. The support member 330 may be formed of pressurized air or a liquid-filled bladder.

Fusing systems and stripping systems having a supported shim in accordance with embodiments, such as stripping systems having a support member 330 as shown in FIG. 3, may be resistant to deformation, weakening, and/or wear. Further, the shim 320 shown in FIG. 3, which surrounds the support member 330, is structured to reduce damage to system components that can be caused by, e.g., an end of the shim in related art systems as shown in FIG. 1. Stripping systems having a support member and shim in accordance with embodiments provide a robust mechanical alternative to related art systems that permit enhanced control over a pressure profile applied at the nip, and extend the life of system components and maintenance of a desired pressure profile for fusing.

Figure 4:
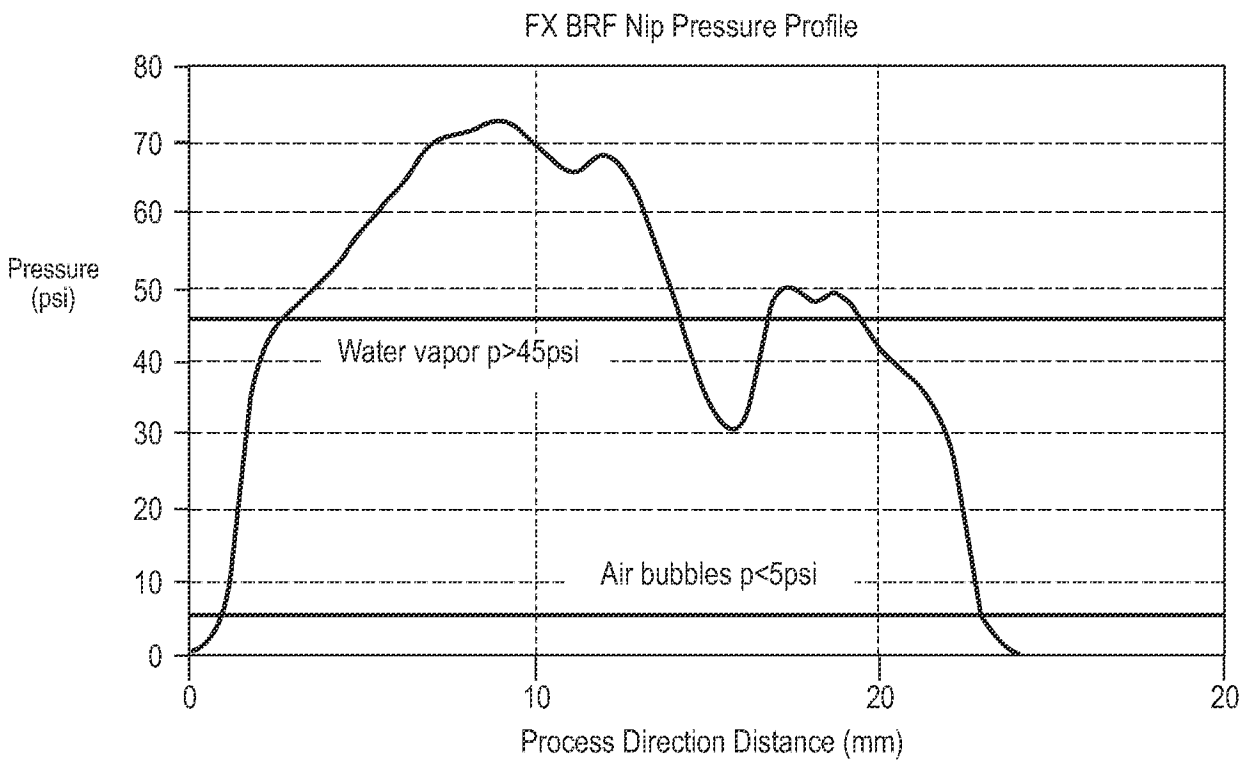
FIG. 4 shows a graph depicting a belt roll fuser nip pressure profile accommodated by a related art stripping system.

FIG. 4 shows a graph depicting results of observations of pressure profile performance accommodated by a related art belt-roll fuser having a related art stripping system. FIG. 4 shows that the pressure profile accommodated by related art systems is inconsistent over a process direction distance of about 25 mm. For example, over time, the nip pressure profile accommodated by the related art belt-roll fuser system falls below 45 psi at least twice, and falls below 5 psi once. As discussed above, the nip pressure profile should be maintained above a water vapor pressure limit and an air bubble pressure limit. The system observed to yield the results shown in FIG. 4 required a water vapor pressure limit of greater than 45 psi, and an air bubble pressure limit of great than 5 psi.

Systems in accordance with embodiments overcome limitations of related art systems by, e.g., including a support member attached to a stripping shoe. The support member supports a shim, which may be a compliant metal shim, to control the shape of the shim and extend the life of the shim by reducing or minimizing vibrations, etc. In alternative embodiments, the shim may surround the support member so that, e.g., a shim tip or end is not exposed and fusing system component damage may be reduced or minimized. Further, systems in accordance with embodiments accommodate a nip pressure profile that reliably maintains nip pressures above required limits, including, e.g., water vapor and air bubble pressure limits.

While apparatus and systems for maintaining a nip pressure profile using a stripping system are described in relationship to exemplary embodiments, many alternatives, modifications, and variations would be apparent to those skilled in the art. Accordingly, embodiments of apparatus and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A belt-roll fuser stripping apparatus, comprising:
a stripping shoe;
a stripping shim; and
a support member that supports the shim,
wherein the shim includes a first end and a second end, the support member being configured to interpose the stripping shoe and one of the first end and the second end of the shim.

2. The apparatus of claim 1, wherein the support member is attached to the stripping shoe.

3. The apparatus of claim 1, wherein the support member comprises rubber.

4. The apparatus of claim 1, wherein the shim comprises metal.

5. The apparatus of claim 1, wherein the first end is attached to the stripping shoe.

6. The apparatus of claim 1, the stripping shim further comprising:
the first end being attached to the stripping shoe; and
a second end, the second end forming a stripping edge, the shim extending from the first end to the second end, and the support member interposing the stripping edge and the stripping shoe.

7. The apparatus of claim 6, the stripping edge being configured to contact an inner portion of a fuser belt.

8. The system of claim 1, wherein the shim maintains a nip pressure profile when the shim contacts the inner portion of the fuser belt at an exit of the fusing nip.

9. A belt-roll fuser system including a belt-roll fuser having an internal pressure member and an external pressure member, the internal pressure member and the external pressure member defining a fusing nip, and a fuser belt, the fuser belt having an inner portion that contacts the internal pressure member and an outer portion that faces the external pressure member at the fixing nip, the system comprising:
a shim, the shim having a contact portion that contacts an inner portion of the fuser belt at an exit of the fusing nip;
a support member that supports the shim; and
a stripping shoe, the stripping shoe being positioned at an exit of the fusing nip,
wherein the shim includes a first end and a second end, the support member being configured to interpose the stripping shoe and one of the first end and the second end of the shim.

10. The system of claim 9, wherein the shim comprises a first end and a second end, the first end of the shim being attached to the stripping shoe.

11. The system of claim 10, wherein the second end forms a stripping edge, the stripping edge being the contact portion that contacts the inner portion of the fuser belt at an exit of the fusing nip.

12. The system of claim 11, wherein the stripping edge contacts the inner portion of the fuser belt during fusing for maintaining a nip pressure profile.

13. The system of claim 10, wherein the shim extends to at least substantially surround the support member.

14. The system of claim 10, wherein the shim extends to substantially surround the support member, the second end being attached to the stripping shoe.

15. A belt-roll fuser stripping system, comprising:
a stripping shoe;
a shim; and
a support member, the support member being attached to the stripping shoe, and the shim being supported by the support member when the shim is applied to an inner portion of a fusing belt of a belt-roll fuser assembly,
wherein the shim includes a first end and a second end, the support member being configured to interpose the stripping shoe and one of the first end and the second end of the shim.

16. The system of claim 15, wherein the shim comprises stainless steel.

17. The system of claim 15, wherein the shim comprises spring steel.

18. A belt-roll fuser stripping system, comprising:
a stripping shoe;
a support member attached to the stripping shoe; and
a shim, the shim being configured to surround the support member, the shim having a first end and a second end, wherein the shim contacts an inner portion of a fuser belt during fusing at a contact point between the first end of the shim and the second end of the shim, to maintain a nip pressure profile,
wherein the shim includes a first end and a second end, the support member being configured to interpose the stripping shoe and one of the first end and the second end of the shim.

* * * * *